US005746194A

United States Patent [19]

Legutko

[11] Patent Number: 5,746,194

[45] Date of Patent: May 5, 1998

[54] CATALYTIC INSERT FOR $NO_x$ REDUCTION

[75] Inventor: Thomas J. Legutko, Canastota, N.Y.

[73] Assignee: Carrier Corporation, Syracuse, N.Y.

[21] Appl. No.: 566,215

[22] Filed: Dec. 1, 1995

[51] Int. Cl.[6] ..... F23D 14/12

[52] U.S. Cl. ..... 126/91 A; 431/347; 431/326; 431/328; 431/170

[58] Field of Search ..... 431/7, 326, 328, 431/347, 348, 170, 268, 350; 126/91 A

[56] References Cited

U.S. PATENT DOCUMENTS

| | | | |
|---|---|---|---|
| 2,044,511 | 6/1936 | Ryschkewitsch | 431/347 |
| 2,259,010 | 10/1941 | Taylor | 431/347 |
| 4,285,666 | 8/1981 | Burton et al. | 431/7 |
| 4,917,599 | 4/1990 | Hasselmann | 431/326 |
| 5,203,690 | 4/1993 | Maruko | 431/170 |
| 5,333,597 | 8/1994 | Kirkpatrick et al. | 431/347 |
| 5,370,529 | 12/1994 | Lu et al. | 431/354 |
| 5,403,184 | 4/1995 | Hosaka et al. | 431/170 |
| 5,437,099 | 8/1995 | Retallick et al. | 29/890 |
| 5,546,925 | 8/1996 | Knight et al. | 431/347 |

FOREIGN PATENT DOCUMENTS

| | | | |
|---|---|---|---|
| 63207915 | 8/1988 | Japan | 431/326 |

*Primary Examiner*—Carl D. Price

[57] ABSTRACT

The fuel in the fuel rich inner cone of the flame is catalyzed by a partial oxidation catalyst into carbon monoxide and hydrogen which have a lower peak flame temperature thereby reducing thermal $NO_x$. The insert is heated and radiates heat with a further reduction of peak flame temperature.

10 Claims, 3 Drawing Sheets

CATALYTIC INSERT FOR $NO_X$ REDUCTION

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2000° K. The flame is zoned so that different parts of the flame are at different temperatures. $NO_x$ production can be reduced with the lowering of the peak flame temperature. The reduction in $NO_x$ is required because it is a prime component in the generation of photochemical smog and reduction can be achieved through turbulence of the gases being combusted and/or by heat transfer from the high temperature portion of the flame. Providing a catalytic coating on combustion apparatus is known as exemplified by U.S. Pat. No. 5,437,099 which discloses the use of a catalyst in the first stage of a multiple-stage combustion device which is specifically disclosed as a gas turbine. In general, a catalyst permits a reaction to take place or speeds up or changes the conditions under which a reaction takes place.

SUMMARY OF THE INVENTION

The present invention takes into consideration the partial premixed structure of an inshot burner flame which has two cones. The inner cone has a fuel rich mixture of natural gas, or the like, and oxygen which can be readily catalyzed by a partial oxidation catalyst into carbon monoxide and hydrogen. The outer cone is where combustion is completed and is the hottest part of the flame. Catalytic partial oxidation involves the use of a catalyst to alter the natural gas fuel input to produce a new fuel stream which is enriched with carbon monoxide and hydrogen. When the new fuel stream is combusted, the peak flame temperatures are lowered which reduces thermal $NO_x$.

The basic premise of the present invention is that for catalysis to be initiated the catalyst must first be heated to a certain activation temperature on the order to 600° F. Rather than using an additional energy source, such as electricity, the present invention uses the flame itself Either the inner or outer flame is used to supply the necessary energy to "light off" the catalyst which then allows the unburnt methane and oxygen inside the inner cone to be catalyzed into hydrogen and carbon monoxide. Additionally, the catalytic insert in using the flame to provide the necessary energy to "light off" the catalyst acts as a heat transfer media thereby tending to reduce the peak flame temperature and further reducing the production of thermal $NO_x$.

It is an object of this invention to provide a radiative heat sink for the flame.

It is another object of this invention to convert methane and oxygen into carbon monoxide and hydrogen through a catalytic reaction.

It is a further object of this invention to reduce the production of thermal $NO_x$. These objects, and others as will become apparent hereinafter, are accomplished by the present invention.

Basically, a catalytic insert is located in or inside the flame of an inshot burner. The catalyst is heated by the flame such that catalysis is initiated thereby allowing unburnt fuel and oxygen inside the inner cone to be catalyzed into hydrogen and carbon monoxide and the heated catalyst provides radiative heat transfer.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
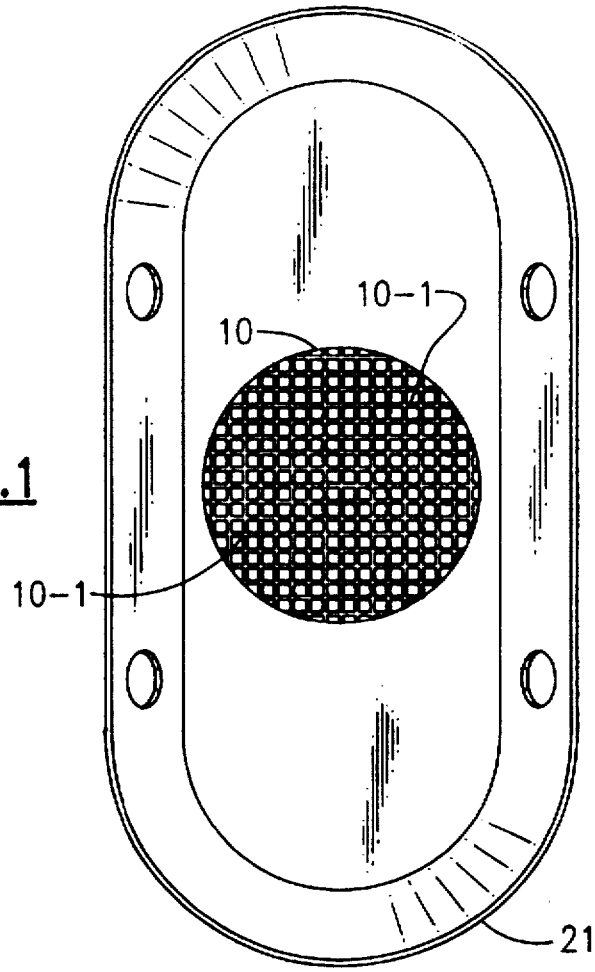
FIG. 1 is an end view of the insert in the bell orifice inlet of the heat exchanger.
Figure 2:
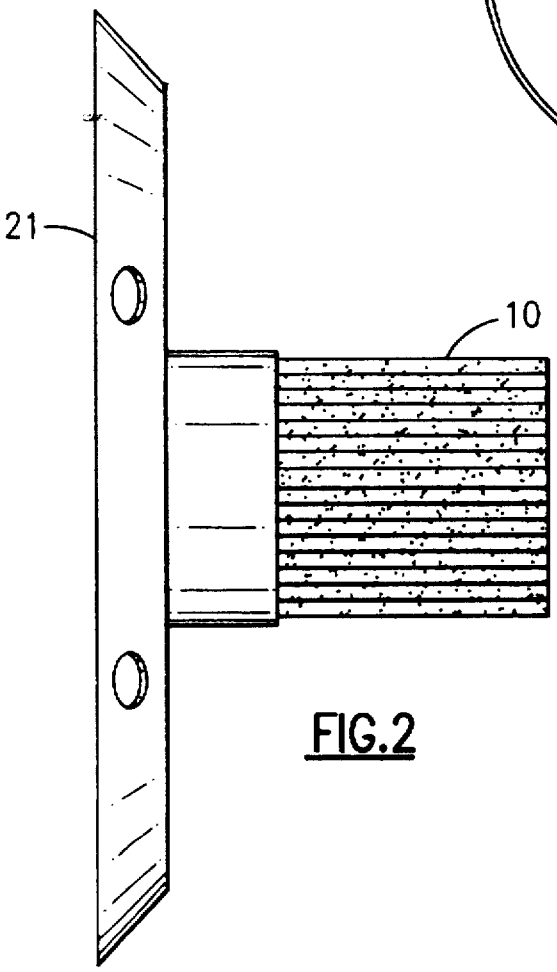
FIG. 2 is a side view of the insert in the bell orifice inlet of the heat exchanger.
Figure 3:
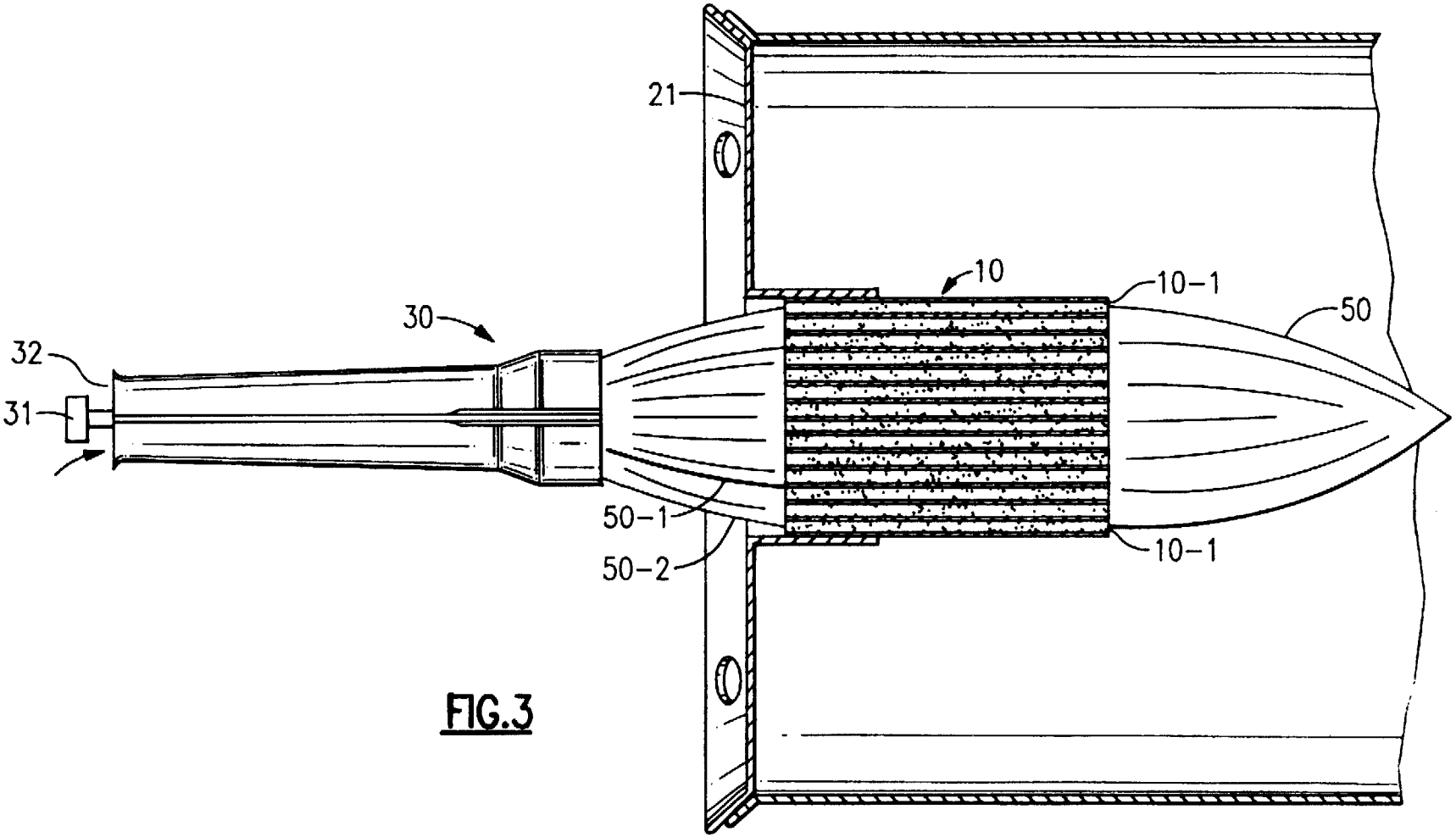
FIG. 3 is a sectional view showing the insert in place.

In FIGS. 1–3 the numeral 10 generally designates the catalytic insert of the present invention. The catalyst can typically be: 1) transition metal oxides such as those of chromium, manganese, or vanadium; 2) noble metals such as platinum, palladium, rhodium, or iridium; 3) materials such as magnesium oxide and pure nickel. In the case of the transition metal oxides and noble metals, they may be a coating on a ceramic matrix such as alumina or a metal matrix such as fecraly, an alloy of iron, chromium and yttrium. In the case of magnesium oxide and pure nickel, the entire insert 10 may be made of catalytic material. Insert 10 is of generally cylindrical shape with a plurality of axially extending, spaced bores 10–1 providing a flow path therethrough. Bores 10–1 have a length to width or diameter ratio of at least two such that the bores 10–1 have much larger surface areas than the cross sections of the flow paths. The surface area is increased by providing rectangular cross sectioned bores 10–1 rather than cylindrical bores.

Turning now to FIG. 3, insert 10 is located in the bell orifice inlet 21 of heat exchanger 20 by any suitable means. Inshot burner 30 is spaced from and faces insert 10 such that insert 10 is in the flame 50 when burner 30 is operating. The location of insert 10 relative to the flame 50 requires that at least a portion is located in inner cone 50-1 to produce catalysis. The heating of the insert to achieve catalysis can be achieved in inner cone 50-1 and/or outer cone 50-2.

In operation, gaseous fuel, such as natural gas, is supplied under pressure to port 31 of inshot burner 30 of a furnace. The gas supplied to port 31 passes annular opening 32 aspirating atmospheric air which is drawn into burner 30. The fuel-air mixture exits burner 30 in flame 50. Flame 50 impinges on insert 10 and passes through bores 10–1 into heat exchanger 20. As illustrated, inner cone 50-1 impinges upon insert 10 and, within bores 10–1, outer cone 50-2 starts to develop such that both inner cone 50-1 and outer cone 50-2 emerge from insert 10. The heat from flame 50 coupled with heat transfer within insert 10 causes the insert to act as a radiative heat sink for flame 50. When the material/catalyst heats up, a portion of the flame's energy will be converted into radiation lowering the flame temperature and reducing $NO_x$. Additionally, through catalysis upon heating the catalyst, the fuel gases and atmospheric air in the fuel rich inner cone 50-1 are changed to hydrogen and carbon monoxide which burn at a lower temperature and further help to reduce thermal $NO_x$.

Figure 4:
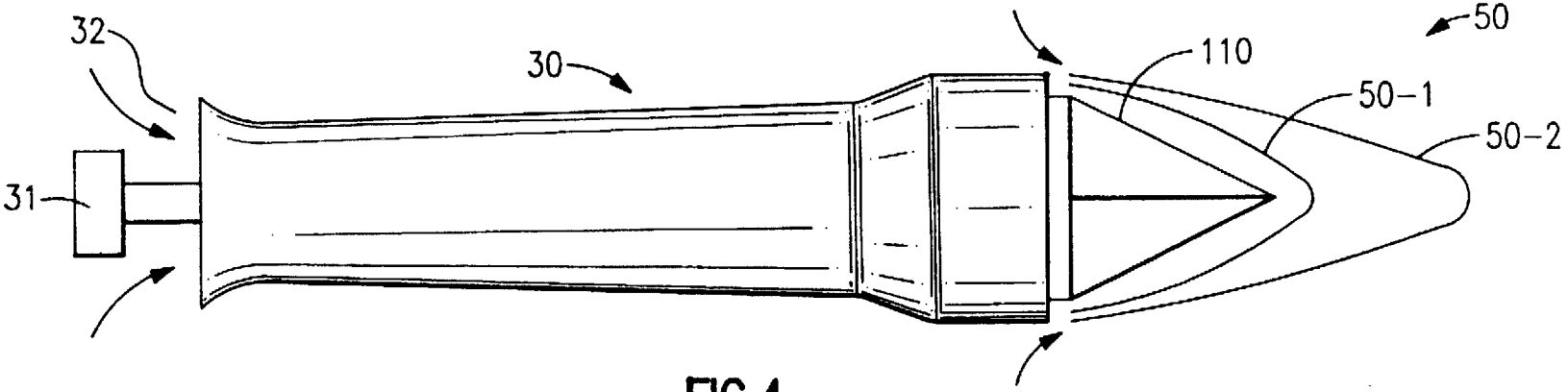
FIG. 4 is a sectional view showing a first modified insert in place.

Referring to FIG. 4, the insert 110 is suitably secured to inshot burner 30 rather than being located in the heat exchanger as in the FIG. 3 device. Additionally, insert 110 is within the inner core 50-1 of flame 50. As in the FIG. 3 device, the flame heats insert 110 which radiates energy and produces catalysis of the fuel rich gases in the inner cone 50-1.

Figure 6:
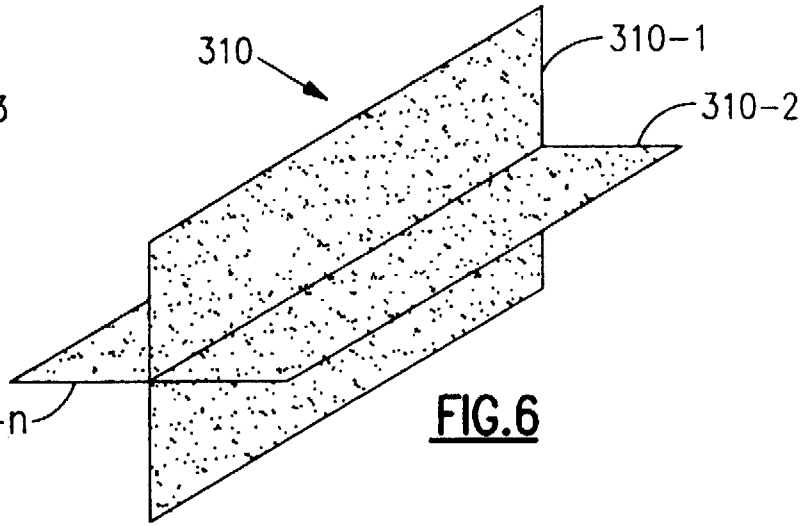
FIG. 6 is a pictorial view of a third modified insert.
Figure 5:
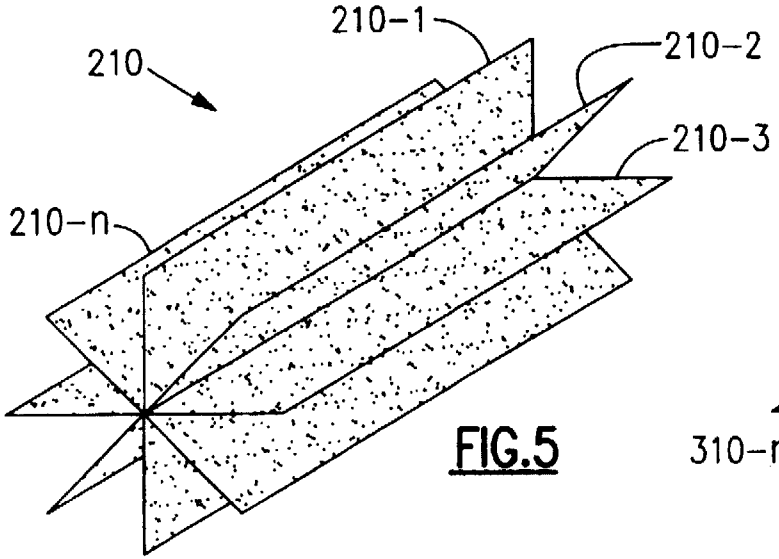
FIG. 5 is a pictorial view of a second modified insert.

Insert 210 which is illustrated in FIG. 5 and insert 310 which is illustrated in FIG. 6 each has a plurality of radially extending surfaces 210-1 to 210-n and 310-1 to 310-n, respectively. Insert 210 and 310 would function like inserts 10 and 110.

Although preferred embodiments of the present invention have been described and illustrated, other changes will occur to those skilled in the art. It is therefore intended that the scope of the present invention is to be limited only by the scope of the appended claims.

What is claimed is:

1. Combustion means for a gas fired furnace comprising:

a burner adapted to burn gaseous fuel and to produce a flame having a fuel rich inner cone and an outer cone;

a matrix located with respect to said burner so as to be located at least partially in said inner cone and defining a plurality of flow paths for said flame;

a partial oxidation catalyst lining said flow paths whereby said catalyst causes catalysis of said fuel in said fuel rich inner cone to produce hydrogen and carbon monoxide and thereby reduces the peak flame temperature.

2. The combustion means of claim 1 wherein said flow paths have a length to width ratio of at least two.

3. The combustion means of claim 1 wherein said flame heats said matrix which provides radiative heat transfer.

4. The combustion means of claim 1 wherein said matrix is located in a heat exchanger facing said burner.

5. The combustion means of claim 1 wherein said matrix is secured to said burner.

6. Means for achieving combustion in a gas fired furnace comprising:

a burner adapted to burn gaseous fuel and to produce a flame having a fuel rich inner cone and an outer cone;

a matrix located with respect to said burner so as to be located at least partially in said inner cone and defining a plurality of flow paths for said flame;

a partial oxidation catalyst lining said flow paths and coacting with said flame such that said catalyst causes catalysis of said fuel in said fuel rich inner cone to produce hydrogen and carbon monoxide and thereby reduces the peak flame temperature.

7. The means of claim 6 wherein said flow paths have a length to width ratio of at least two.

8. The means of claim 6 wherein said flame heats said matrix to activate said catalyst which provides radiative heat transfer.

9. The means of claim 6 wherein said matrix is located in a heat exchanger facing said burner.

10. The means of claim 6 wherein said matrix is secured to said burner.

* * * * *